United States Patent [19]

Fenne

[11] 4,346,841

[45] Aug. 31, 1982

[54] FUEL INJECTION NOZZLE UNIT

[75] Inventor: Ivor Fenne, Greenford, England

[73] Assignee: Lucas Industries Limited, Birmingham, England

[21] Appl. No.: 224,696

[22] Filed: Jan. 13, 1981

[30] Foreign Application Priority Data

Feb. 2, 1980 [GB] United Kingdom ..... 8003564

[51] Int. Cl.[3] ..... F02M 47/02

[52] U.S. Cl. ..... 239/125; 137/312; 137/509

[58] Field of Search ..... 137/312, 509; 239/124, 239/125, 126, 533.3, 533.4, 533.5, 533.6, 533.7, 533.8, 533.9, 533.11

[56] References Cited

U.S. PATENT DOCUMENTS 3,948,446 4/1976 Goyal ..... 239/533.3 X 4,186,884 2/1980 Mowbray ..... 239/533.8

4,261,513 4/1981 Andrews ..... 239/125

*Primary Examiner*—Harold W. Weakley

[57] ABSTRACT

A fuel injection nozzle unit includes a differential valve member biased by a spring to a closed position and opened to allow fuel flow through an outlet by fuel under pressure from an inlet. The spring is housed within a spring chamber and fuel leaking into this chamber is vented to the inlet when delivery of fuel has ceased. A relief valve is provided which has a valve element having a surface exposed to the pressure in the chamber and an opposing surface exposed to the pressure exterior of the nozzle unit. The valve element is biased to a closed position by a spring and it controls flow along a path from the chamber to the inlet. The flow path also incorporates a non-return valve. The valve element is set to lift from its seating at a pressure which is greater than the residual pressure in the inlet plus the pressure required to open the non-return valve.

4 Claims, 1 Drawing Figure

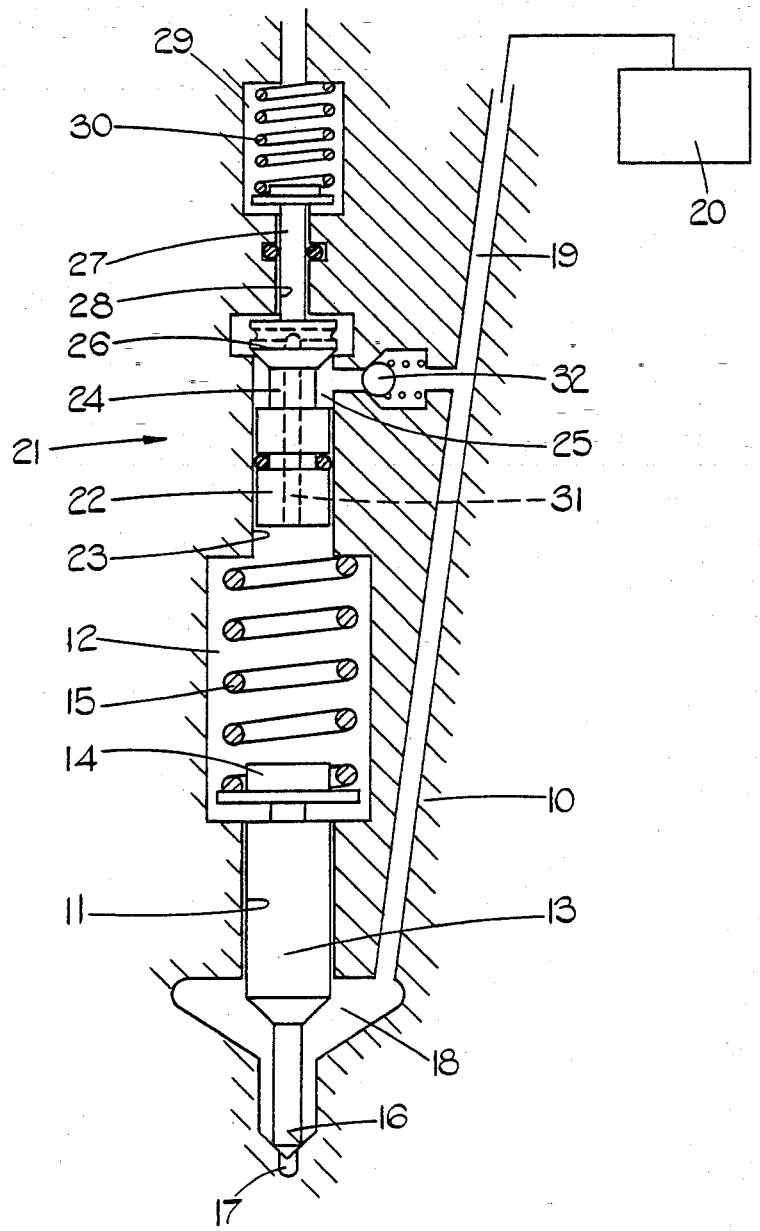
29
30
27
28
26
24
21
22
23
12
15
14
11
20
19
32
25
31
10
13
18
16
17

FUEL INJECTION NOZZLE UNIT

This invention relates to fuel injection nozzle units of the kind intended to supply fuel to a compression ignition engine and comprising a body defining a bore, a valve member slidable in the bore for controlling the flow of fuel through an outlet, resilient means loading the valve member in a direction to prevent flow of fuel through the outlet, said resilient means being located within a chamber defined in the body and into which fuel can leak from the working clearance defined between the valve member and the wall of the bore, means for draining fuel from said chamber, the body defining an inlet for liquid fuel under pressure, the pressure of fuel in use, acting on the valve member to lift the valve member against the action of the resilient means.

In order to allow the fuel collecting in the chamber to escape it is the practice to provide a drain passage in the body and to provide, in use, a connection which connects the drain passage to a drain. This allows the fuel to escape and so prevents a build up of fuel under pressure in the chamber although in some cases a rise in the pressure in the chamber is allowed in order to assist the action of the resilient means.

The need to provide the connection to the drain presents problems with the installation of the nozzle unit particularly in the situation where the nozzle units of the engine are located under the rocker cover of the engine valve gear. If this is the case it is necessary to provide a connection to the drain through the rocker cover to prevent any leakage of fuel from the nozzle units diluting the lubricating oil of the engine.

It is known to vent the aforesaid chamber to the fuel inlet by way of a non-return valve which opens when the fuel pressure at the fuel inlet falls to the residual pressure at the end of fuel delivery. The pressure in the chamber is therefore equal to the residual pressure plus the pressure required to open the non-return valve. Since the residual pressure in use can vary it means also that the pressure in the chamber can vary. The pressure in the chamber acts on the valve member to assist the action of the resilient means and therefore there will be a variation in the pressure required to lift the valve member.

The object of the present invention is to provide a fuel injection nozzle of the kind specified in a form in which no external connection is required to drain away the fuel collecting in the chamber and the pressure in the chamber in use is substantially independent of variations in the residual pressure at the fuel inlet.

According to the invention a nozzle unit of the kind specified comprises a relief valve including a valve element having one surface exposed to the pressure in the chamber and an opposing surface which is exposed to the pressure exterior of the nozzle unit, resilient means biassing the valve element to a closed position, the pressure in said chamber acting upon said one surface to move the valve element to an open position to allow fuel to flow to said fuel inlet and a non-return valve through which the fuel flows to said inlet, the pressure required to move said valve element to the open position being greater than the sum of the maximum residual pressure at the fuel inlet when in use the delivery of fuel has ceased, and the pressure required to open the non-return valve.

An example of a fuel injection nozzle unit in accordance with the invention will now be described with reference to the accompanying drawing which is diagrammatic in nature.

Referring to the drawing there is provided a body 10 in which is formed a cylindrical bore 11 which forms a continuation of a chamber 12. Slidable within the bore is a valve member 13 which at its end adjacent the chamber, mounts a spring abutment 14. The abutment 14 locates one end of a coiled compression spring 15, the other end of the spring bearing against an end wall of the chamber.

At its other end the valve member is of reduced diameter and is tapered for co-operation with a seating 16 which is formed about an outlet 17. An annular space 18 is defined in the body and this space communicates with a fuel inlet passage 19 which in use, is connected to a fuel injection pump 20. The pump 20 is driven in timed relationship with the associated engine.

In use, when fuel under pressure is supplied by the injection pump, the fuel acts upon the stepped surface of the valve member 11 to lift the valve member against the action of the spring 15. When this occurs fuel can flow through the outlet 17, the valve member closing onto the seating 16 when the delivery of fuel by the injection pump ceases. When the delivery of fuel ceases the pressure in the passage 19 falls to a residual value thereby enabling the valve member 13 to move quickly to the closed position. The residual fuel pressure is very much less than the pressure required to lift the valve member against the action of the spring 15 but it is not a constant pressure for all operating speeds of the engine.

In use fuel leaks along the working clearance defined between the valve member and the wall of the bore 11, such fuel flowing into the chamber 12. If the fuel pressure in the chamber 12 were allowed to rise to a sufficient value, the valve member 13 would be unable to open.

In order to control the pressure within the chamber 12, a relief valve generally indicated at 21 is provided. The valve comprises a valve element 22 slidable in a bore 23 which communicates with the chamber 12. The valve element has a generally cylindrical portion which guides its axial movement within the bore, a reduced portion 24 which defines an annular chamber 25 with the wall of the bore 23 and a head 26. Integrally formed with the element is a cylindrical extension 27 which extends through a bore 28 into a further chamber 29. The chamber 29 communicates with the exterior of the nozzle unit and is therefore subject to the pressure surrounding the nozzle unit. In the majority of cases this will be atmospheric pressure but it may be slightly less than atmospheric pressure where the nozzle unit is located within the rocker cover of the engine and the latter is provided with a crank-case ventilation system.

The valve element 22 is biassed by a spring 30 which is located in a chamber 29 and the effect of the spring is to bias the head 26 into contact with a seating defined at the end of the bore 23 remote from the chamber 12, the bore being slightly enlarged in the vicinity of the head.

Formed in the valve element and extending from the chamber 12 is an axial drilling 31 which extends into the head 26 where it communicates with a transverse drilling. The annular space 25 is connected to the inlet passage 19 by way of a spring loaded non-return valve 32.

The force exerted by the spring 30 upon the valve element 22 is such that the pressure in the chamber 12 must rise above the maximum residual pressure in the passage 19 plus the pressure required to open the non-return valve 32. In operation therefore as soon as the pressure in the chamber rises to the value determined by the spring 30, the valve member 32 will lift to place the chamber 12 in communication with the annular space 25. If delivery of fuel is taking place the non-return valve 32 will remain closed but if the pressure in the passage 19 is at its residual value, the valve 32 will open to permit fuel to flow from the chamber 12 into the passage 19. The valve member will close onto its seating when the pressure in the chamber 12 has been reduced to the value determined by the spring 30. The non-return valve 32 acts to prevent fuel at injection pressure passing into the spring chamber 12 in the event that the valve member 21 is lifted when fuel is delivered by the injection pump 20.

The valve member 22 is subjected at one end to the pressure in the chamber 12, and its other end to the pressure in the chamber 29 it will always lift therefore at the pressure which is determined by the spring 30.

It will be noted that the valve member 22 is provided with a circumferential groove which accommodates an O-ring which co-operates with the wall of the bore 23. Moreover, the bore 28 is provided with a groove which again accommodates an O-ring to establish a seal between the bore 28 and the extension 27. Any slight leakage of fuel which might take place into the chamber 29 will be so small as to have no effect upon the lubricating oil of the engine.

The construction described does of course have the advantage that the pressure in the chamber 12 can rise above atmospheric pressure so that the fuel pressure can assist the action of the spring 15 in maintaining the valve member in contact with its seating. This means that the spring 15 can be smaller than would otherwise be necessary.

I claim:

1. A fuel injection nozzle unit of the kind intended to supply fuel to a compression ignition engine and comprising a body defining a bore, a valve member slidable in the bore for controlling the flow of fuel through an outlet, resilient means loading the valve member in a direction to prevent flow of fuel through the outlet, said resilient means being located within a chamber defined in the body and into which fuel can leak from the working clearance defined between the valve member and the wall of the bore, means for draining fuel from said chamber the body defining an inlet for liquid fuel under pressure, the pressure of fuel in use, acting on the valve member to lift the valve member against the action of the resilient means, the means for draining fuel from said chamber comprising a relief valve including a valve element having one surface exposed to the pressure in the chamber and an opposing surface which is exposed to the pressure exterior of the nozzle unit, resilient means biassing the valve element to a closed position, the pressure in said chamber acting upon said one surface to move the valve element to an open position to allow fuel to flow to said fuel inlet and a non-return valve, through which the fuel flows to said inlet, the pressure required to move said valve element to the open position being greater than the sum of the maximum residual pressure at the fuel inlet when in use the delivery of fuel has ceased, and the pressure required to open the non-return valve.

2. A nozzle unit according to claim 1 in which said valve element includes a head for co-operation in the closed position of the valve element with a seating, a passage extending through the valve element from said chamber, and a annular space defined by said valve element and which is connected to said fuel inlet through said passage.

3. A nozzle unit according to claim 2 in which said non-return valve is located in the body.

4. A nozzle unit according to claim 2 in which said valve element is provided with an extension which defines said opposing surface, and sealing means located between the main portion of the valve element and said extension and the respective walls of the bores in which they are located for minimising fuel leakage.

* * * * *